US007604024B2

(12) United States Patent
Jacobsson et al.

(10) Patent No.: US 7,604,024 B2
(45) Date of Patent: Oct. 20, 2009

(54) YARN BRAKE

(75) Inventors: Kurt Arne Gunnar Jacobsson, Ulricehamn (SE); Per Ohlson, Tvaerred (SE); Fiorenzo Ghiardo, Pettinengo (IT); Andrea Maffeo, Cavaglia (IT)

(73) Assignee: Iropa AG, Baar (CH)

( * ) Notice: Subject to any disclaimer, the term of this patent is extended or adjusted under 35 U.S.C. 154(b) by 804 days.

(21) Appl. No.: 10/492,216

(22) PCT Filed: Jul. 26, 2002

(86) PCT No.: PCT/EP02/08350

§ 371 (c)(1),
(2), (4) Date: Feb. 10, 2005

(87) PCT Pub. No.: WO03/033385

PCT Pub. Date: Apr. 24, 2003

(65) Prior Publication Data

US 2005/0145290 A1 Jul. 7, 2005

(30) Foreign Application Priority Data

Oct. 12, 2001 (DE) ..... 101 50 504

(51) Int. Cl.
*D03D 35/00* (2006.01)

(52) U.S. Cl. ..... 139/200

(58) Field of Classification Search ..... 188/65.1; 139/194, 200; 28/222, 225
See application file for complete search history.

(56) References Cited

U.S. PATENT DOCUMENTS

| | | | | | |
|---|---|---|---|---|---|
| 2,888,216 | A | * | 5/1959 | Simons, Jr. et al. | 242/419.1 |
| 3,926,224 | A | * | 12/1975 | Vermeulen et al. | 139/453 |
| 4,294,417 | A | | 10/1981 | Camardella | |
| 4,605,182 | A | | 8/1986 | Zollinger | |
| 4,875,506 | A | | 10/1989 | Gacsay et al. | |
| 5,244,164 | A | | 9/1993 | Gacsay | |
| 5,483,997 | A | * | 1/1996 | Corain et al. | 139/194 |
| 6,161,595 | A | * | 12/2000 | Shaw et al. | 139/194 |
| 2007/0169830 | A1 | * | 7/2007 | Christe | 139/448 |

FOREIGN PATENT DOCUMENTS

| | | |
|---|---|---|
| EP | 0 294 323 | 12/1988 |
| EP | 0 498 758 | 8/1992 |
| JP | 08-60500 | 3/1996 |

* cited by examiner

*Primary Examiner*—Shaun R Hurley
*Assistant Examiner*—Andrew W Sutton
(74) *Attorney, Agent, or Firm*—Flynn, Thiel, Boutell & Tanis, P.C.

(57) ABSTRACT

The invention concerns a yarn brake (B) comprising a brake (L) electromagnetically stressed against a fixed braking surface (17), a housing (1) whereon the cover bearing the brake (L) is mounted such that it is capable of being lifted relative to the fixed braking surface (17), and at least an adjusting arbor (S) controlling the lifting movements of the cover, said arbor being mounted on the housing (S) in geometric association to the path of the yarn (W). The invention is characterised in that the cover is a flap cover (K) mounted so as to be capable of being lifted about the adjusting arbor (S) for completely clearing the braking zone (12) of the yarn tension device (B).

30 Claims, 4 Drawing Sheets

YARN BRAKE

FIELD OF THE INVENTION

The present invention relates to a yarn brake, and to a method of cleaning a yarn brake.

BACKGROUND OF THE INVENTION

The cover lid of the yarn brake for shuttleless weaving machines as known from EP 02 94 323 A (U.S. Pat. No. 4,875,506) can be lifted in parallel fashion from the fixed braking surface over a small stroke only and by means of two links. The links pivot against spring force about adjusting arbors which extend perpendicular to the yarn path. Since the cover lid partly covers the braking zone even in the lifted position, it is not possible to then gain free access or to have an unobstructed view into the braking zone. Alternatively, the braking lamella may be secured to an arbor which is fixed in the housing against rotation. The braking lamella is biased against the fixed braking surface. The braking zone cannot be cleared completely when the lamella is lifted by hand.

The cover lid of the yarn brake according to EP 04 98 758 A (U.S. Pat. No. 5,244,164) is movable over a short stroke about an adjusting arbor which extends parallel to the fixed braking surface. Since the braking zone cannot be cleared totally, neither unobstructed access nor a free view into the braking zone are possible. The yarn brake is equipped with a pressurised air-cleaning system which is provided at the cover lid or at the brake housing, respectively. The cleaning system directs air jets into the braking zone crosswise to the yarn running direction.

The braking lamella of the yarn brake for a rapier weaving machine as known from U.S. Pat. No. 6,161,595 is permanently pressed by a coil spring with a basic load against the fixed braking surface. The coil spring is supported by a portal-shaped structure. In addition, the contact pressure of the braking lamella is controlled by magnet force depending on the weaving cycles. Yarn brakes produced according to U.S. Pat. No. 6,161,595 and as employed in practice comprise channels for pressurised air. The channels are integrated into the housing and lead to channel ports. The air nozzles open freely at the side of the braking nip defined between the braking lamella and the fixed braking surface. This design negatively influences the efficiency of cleaning processes and causes high consumption of pressurised air.

For maintenance, for cleaning, and if necessary, for checking the degree of contamination, for replacing the braking lamella, or for re-threading and for similar operations free access and an unobstructed view to or into the braking zone would be expedient. This ought to be possible rapidly and without significant readjustments or mounting work steps. Furthermore, the yarn brake ought to be cleaned efficiently by pressurised air in order to remove lint collected in the area of the braking zone. These requirements occurring in practice cannot be met satisfactorily by the known yarn brakes.

SUMMARY OF THE INVENTION

It is an object of the invention to provide a yarn brake of the type as disclosed above which allows to fulfil the requirements occurring in practice in terms of a quick, unhindered access or view on or into the braking zone and/or in terms of efficiently cleaning by pressurised air in a structurally simply fashion.

The flap cover supported for a one-sided tilting motion when opened is not only lifted from the fixed braking surface, but additionally is moved with its free end region far away from the fixed braking surface. In this way the braking zone can be totally cleared. There is unhindered access to the braking zone and also a full view on the braking zone. That is, the fixed braking zone and the surrounding of the fixed braking zone then are accessible as well as the braking lamella and the surrounding of the braking lamella at the flap cover. The flap cover can be opened and closed rapidly such that no significant down time of the peripheral assemblies of the yarn brake is needed for a check or the like. The handling is extremely comfortable. The structures needed to achieve this comfort function are simple.

In case of so-called leaf tensioners the exit side of the leaf tensioner opens in a diverging fashion due to the geometric design of the leaf. When pressurised air is blown into the exit side opposite to the yarn running direction and substantially parallel to the yarn running direction when the yarn has stopped, the braking lamella will be lifted. The pressurised air passes through the braking zone. Deposited contamination can be released and removed already with moderate consumption of pressurised air.

In case of magnetically controlled lamella-yarn brakes the pressurised air is blown in when the yarn has stopped and when the braking lamella is magnetically deactivated. The pressurised air is preferably blown into the diverging and open exit side, because then the contact pressure of the braking lamella will be at a minimum and the braking lamella will yield easily.

Expediently, the adjusting arbor is situated substantially parallel to the yarn run path and is offset to one side of the fixed braking surface. The flap cover pivots upwardly and, at the same time, moves sidewardly totally away from the braking zone. Access to the braking zone then is possible from all sides and particularly from the top side.

Alternatively, the adjusting arbor could be placed substantially parallel to the fixed braking surface and perpendicular to the yarn run path. As soon as the flap cover is opened it clears the entire braking zone for free access. In case that the adjusting arbor is positioned offset in relation to the yarn run path, e.g. upwardly, this even results in more comfortable options for access to the braking zone. The adjusting arbor may be placed at the entrance side or at the exit side of the fixed braking surface, respectively.

In a structurally simple way the adjusting arbor may be formed by a flap cover hinge provided in the housing.

In an alternative solution the flap cover is connected to two adjusting arbors by means of a link mechanism including two links of different lengths. The adjusting arbors are offset in relation to each other. This design results in a precisely controlled opening tilting movement of the flap cover which moves sidewardly or in longitudinal direction away from the fixed braking surface when opened.

A gripping handle at the flap cover enhances the comfort for handling the flap cover. An upwardly bent handle already optically indicates the area in which the flap cover has to be gripped for opening or closing. Thanks to the long lever arm of the gripping handle a small actuation force will suffice.

The yarn brake can be compact if the flap cover is countersunk in the closed position between yarn guiding elements fixed to the housing. In the closed position the cover flap shields the braking zone against the exterior. When the flap cover is fully opened, free access to the entire braking zone is possible.

A tilting angle of the flap cover of more than 90° is expedient as this allows free access to the braking zone from all sides. Particularly expedient is an opening angle of almost 180°, e.g. of about 150°.

A positioning device at least for the closed position and/or the opened position of the flap cover results in increased comfort of handling the yarn brake. The opened flap cover does not need to be held. In the closed position, the flap cover has a position which is of advantage for the correct operation of the braking lamella.

In a structurally simple way the positioning device is equipped with a snap detent mechanism and abutting surfaces for the flap cover.

A well defined positioning of the braking lamella with a degree of freedom as needed for the correct operation can be assured if pin anchors are fixed at the flap cover such that they are oriented perpendicular to the yarn run path. By means of such pin anchors at the entrance side the braking lamella is dragged by the yarn in the closed position of the cover flap. Furthermore, the braking lamella remains correctly positioned but is held in moveable fashion.

The braking lamella may have hang-in cut-outs open to the longitudinal edges of the braking lamella. The pin anchors engage into the hang-in cut-outs. The opened hang-in cut-outs can be manufactured expediently and facilitate the replacement of the braking lamella, because then the pin anchors do not need to be removed. Expediently, the pin anchors are formed with enlarged heads such that the hang-in braking lamella may not fall off.

In order to achieve a predetermined basic braking effect even without active magnet force, at least one spring may be provided between the lower side of the flap cover and the braking lamella.

In order to avoid a wobbling motion of the braking lamella when the yarn is running and the electromagnet is not energised, the spring ought to consist of damping materials like polyurethane, foam material, elastomer or a dead rubber material. Alternatively, the spring ought to contain at least one damping insert made from a damping material. In this way the spring generates the load needed for the basic braking effect, however, allows movements or lifting movements of the braking lamella in relation to the fixed braking surface which movability is particularly useful for cleaning cycles with pressurised air. The spring, furthermore, dampens oscillations of the braking lamella caused by the yarn run when only the basic braking effect is active.

The spring may be an S-shaped polyurethane lip which extends crosswise over the width of the braking lamella.

The flap cover ought to consist of non-magnetic material like light metal or plastic such that the flap cover does not dissipate electromagnetic power.

As a counter measure to functional disturbances caused by deposited contamination or lint the yarn brake ought to be equipped with a pneumatic cleaning device. At least one nozzle supplied with pressurised air may be directed from the exterior of the braking zone into the braking zone. The nozzle e.g. is located at the entrance side between the yarn guiding element and the braking zone.

Particularly, if yarn qualities are processed containing horse hair or of cotton containing seed-coats, contamination originating from the yarn material first will deposit in the outer surroundings of the braking zone and then furthermore even inside the braking zone. Such contamination gradually grows and then disturbs the function of the yarn brake. The pneumatic cleaning device of the yarn brake removes such contamination. In this case it is intended to efficiently consume the pressurised air but to clean effectively at the same time. In known yarn brakes of this kind, namely a significant part of the pressurised air supplied for cleaning is wasted.

In view to an efficient consumption of the pressurised air and an effective cleaning process it might be expedient to shield the exit area of the nozzle at the longitudinal edge region of the braking zone by a throttling gap. The throttling gap, expediently, is bound by a wall which is substantially perpendicular to the fixed braking surface, and by the braking lamella itself. The throttling gap is dimensioned so small that just no contact can occur between the braking lamella and the wall. On the other hand, only as little pressurised air as possible then is allowed to leak to the outside. Thanks to the throttling gap a major part of the supplied pressurised air will be effective in the braking zone such that even with low consumption of pressurised air an effective removal even of critical contamination can be achieved.

The cleaning effect can be intensified by providing several nozzles along the longitudinal edge region of the braking zone. In order to efficiently consume the pressurised air each of the several nozzles may have a relatively small exit cross-section.

In order to achieve an effective shielding of the exit area against wasted pressurised air and in order to force the pressurised air into the braking zone, the braking lamella defining one boundary of the throttling gap even may be broadened in relation to the fixed braking surface.

In an alternative embodiment, expediently, a nozzle is mounted in at least one of the cheeks of the yarn brake. The cheek of the yarn brake contains a yarn guiding element. The blowing direction of the nozzle is substantially parallel to the yarn run path. The nozzle is directed in the plane of the braking zone and into the braking nip but is offset sidewardly in relation to the yarn run path. The pressurised air exiting the nozzle enters the braking zone at the side of the yarn run path through the braking zone, namely in locations where contamination tends to collect, while the yarn run path per se is cleared by the yarn itself.

The nozzle may be mounted directly in the yarn guiding element. The yarn guiding element with the mounted nozzle may form a replacement part which is intended to replace a conventional yarn guiding element in case that the yarn brake is equipped with a pneumatic cleaning device.

Expediently, the nozzle provided in the cheek at the exit side works with a blowing direction opposite to the yarn run direction. In this case, contamination at the entrance side will be blown away particularly effectively by the air coming from the exit side. For cleaning, such contamination then will not be conveyed through the entire braking zone.

The nozzle is connected to a solenoid valve allowing to selectively activate the pneumatic cleaning device. The solenoid valve is connected to an actuation control device. The actuation control device actuates the nozzle at the respective optimum point in time, for a desired time duration, and, e.g. with selected intensity.

Expediently, the actuation control device is connected to a control device of the yarn brake and/or with the control device of the weaving machine in order to initiate a cleaning cycle when the yarn brake is deactivated and the yarn has stopped. In some cases, the solenoid valve even may be controlled directly from the control device of the yarn brake or from the control device of the weaving machine, respectively.

Expediently, the pneumatic cleaning devices of several yarn brakes in a yarn processing system may be connected to a common solenoid valve. However, a single solenoid valve is preferred for each yarn brake, or even a single solenoid valve at each yarn brake, because the several yarn brakes in the system typically will be deactivated at different times. It is best to carry out the cleaning cycle then when the yarn has stopped while the weaving shed is closed. A cleaning cycle lasts at maximum until the yarn starts to run again. It is not necessary to clean during each pause between two picks, but it may suffice in some cases to carry out the cleaning cycle only after a predetermined number of picks. The cleaning cycle may be carried out such that pressurised air is blown out permanently, or alternatively only in pressurised air pulses.

Expediently, the actuation control device is provided with a program section allowing to adjust the cleaning cycles in dependence from deactivation cycles of the yarn brake and/or the operating cycles of the weaving machine, respectively.

It may be particularly expedient to integrate the nozzle and the solenoid valve and a pressurised air connection between the nozzle and the solenoid valve into a kit which can be or is mounted at the yarn brake.

In case that the yarn brake is pre-equipped with mounting devices for the kit, a later retrofit of the yarn brake into a yarn brake containing a pneumatic cleaning device can be carried out at any time.

BRIEF DESCRIPTION OF THE DRAWINGS

Embodiments of the subject of the invention will be explained with the help of the drawings wherein.

DETAILED DESCRIPTION

Figure 1:
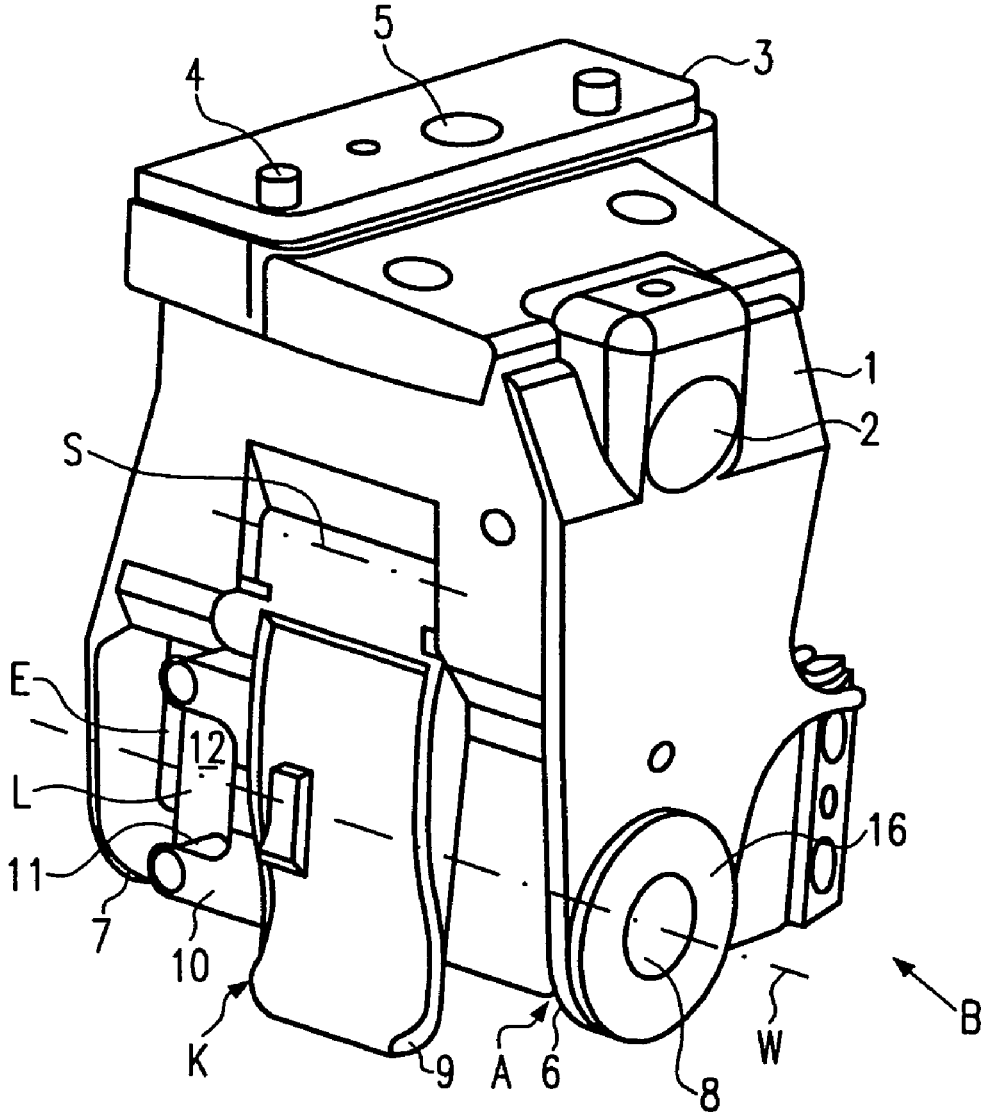
FIG. 1 is a perspective view of a yarn brake in operating position.
Figure 2:
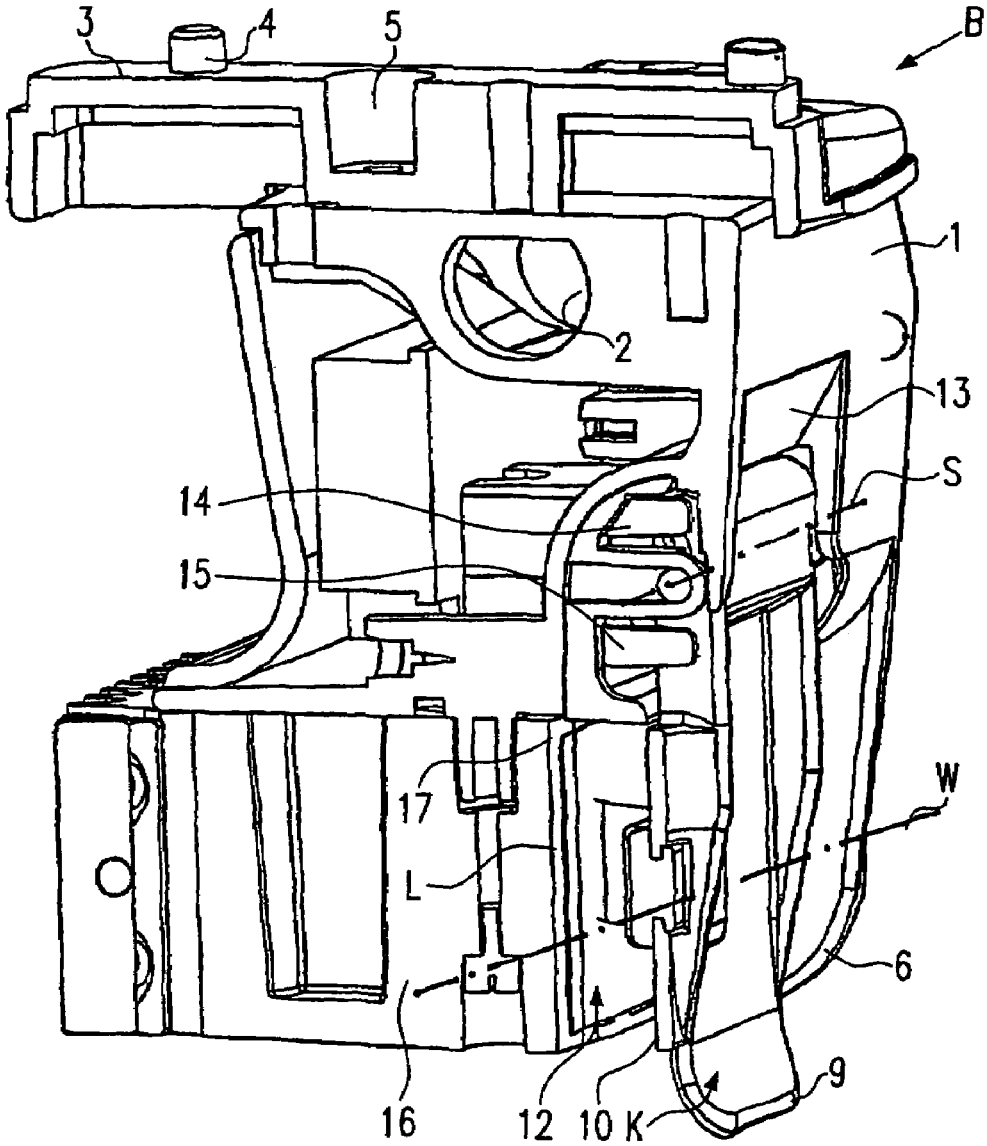
FIG. 2 is a perspective partial sectional view of the brake, in a viewing direction which is inverse to the viewing direction of FIG. 1.
Figure 3:
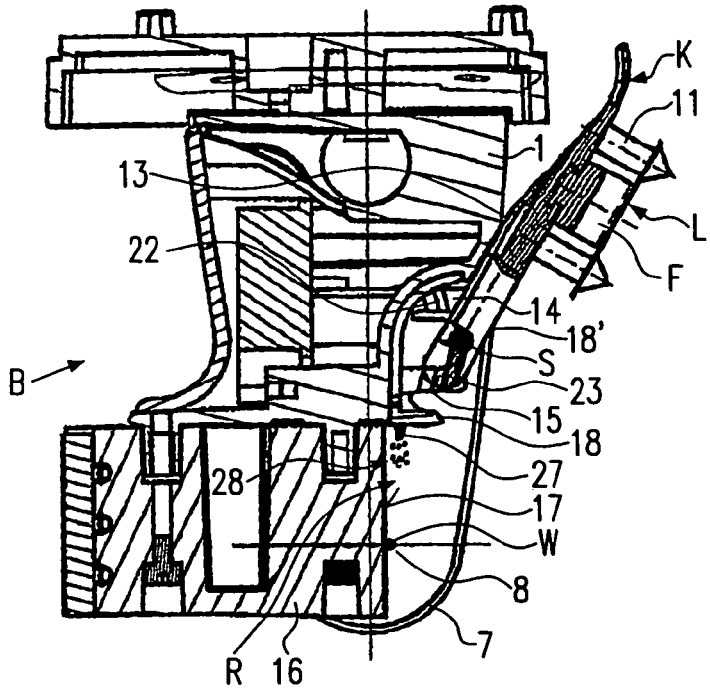
FIG. 3 shows schematically the opened position of a flap cover of the yarn brake of FIGS. 1 and 2.

A yarn brake B has in FIGS. 1 and 2 a block-shaped housing 1 and an integrated solenoid housing 16. A lateral passage 2 of the housing serves to position the yarn brake B for operation, e.g. on a holding rod. Alternatively, the yarn brake B may be secured with the help of a fixation plate 3 e.g. at a housing bracket of a not shown yarn feeding device. Positioning pins 4 serve to safeguard the yarn brake mounting position. A port 5 for pressurised air, e.g. provided in the fixation plate 3, serves in some cases to supply pressurised air to a cleaning system of the yarn brake. The housing 1 includes side cheeks 6, 7 containing yarn guiding elements 8 (yarn eyelets) defining a yarn run path W through the yarn brake B. The braking zone 12 of the yarn brake B partially indicated in FIG. 1 is covered by a flap cover K. The flap cover can be tilted open about an adjusting arbor S of the housing 1. The adjusting arbor S is a tilting hinge. The flap cover K has a handle 9 which e.g. is bent upwardly. The flap cover K can be tilted open from the shown closed position, preferably over more than 90°, i.e. to almost 180°, or as shown (FIG. 3) over about 150°. The adjusting arbor S is situated substantially parallel to the yarn run path W and is offset sidewardly in relation to the yarn run path W. The adjusting arbor S is situated beside the fixed braking surface 17 and in an elevated position in relation to the fixed braking surface (FIG. 3). Two pin anchors 11 are secured to bosses 10 of the flap cover K along a line oriented crosswise to the yarn run path W. The pin anchors 11 serve to loosely position a braking lamella L. The braking lamella L co-operates in the braking zone 12 (FIG. 2) with the fixed braking surface 17 which is provided at the solenoid housing 16.

The yarn run path W extends at the side of the middle of the width of the braking lamella L. An abutment surface 13 for the flap cover K is provided in the housing 1. The flap cover K is held in abutment with the abutting surface 13 in the opened position (FIG. 3) by means of an elastic detent mechanism. Sidewardly positioned flaps 14, 15 serve to achieve the detent function. The flaps 14, 15 define elastic positioning devices for the closed position and the opened position of the flap cover K, respectively, and in co-action with the abutment surface 13 (and a further abutment surface 18) of the housing 1 (FIG. 3). The flap cover K may consist of non-magnetic material such as light metal or plastic.

Figure 4:
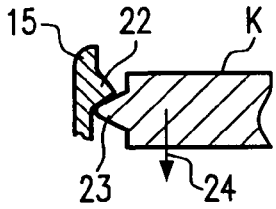
FIG. 4 is a detail of FIG. 3.

Each flap 15, 14 consisting of plastic or metal material has an inside hill 22 in FIGS. 3 and 4 for co-action with a counter hill 23 at the side of the flap cover K, and in order to generate a closing force. In an analogous fashion the flaps 14 also may generate a force in an opposite direction. According to FIG. 3 a spring F may be provided between the lower side of the flap cover K and the braking lamella L. The spring F serves to produce a basic load for pressing the braking lamella L against the fixed braking surface 17 in the closed position of the flap cover K. The closed position is stabilised in FIG. 3 by contact between an abutment surface 18' at the lower side of the flap cover K and the abutment surface 18 of the housing 1. At the same time, an elastic detent force is produced by the flaps 15.

Expediently, the yarn brake B is equipped with an integrated pneumatic cleaning device R. FIG. 3 shows at least one nozzle 27 in the housing 1. The nozzle is connected to the pressure supply port 5 of FIGS. 1 and 2 and may direct a cleaning air jet 28 or single air jet pulses e.g. from the exterior of the braking zone 12 into the entrance side E. At least one nozzle 27 is expediently provided at least at the entrance side E of the yarn brake B (FIG. 8) and/or in some cases even a further, not shown nozzle at the exit side A.

Figure 5:
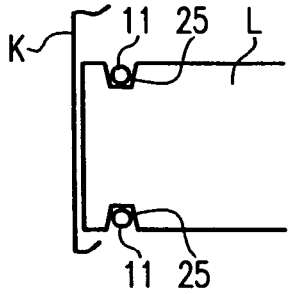
FIG. 5 is a view of the flap cover from below.

The pin anchors 11 in FIG. 3 are formed with enlarged heads such that they can loosely hold the braking lamella L. According to FIG. 5 the braking lamella L e.g. is loosely positioned at the pin anchors 11 with the help of hang-in cut-outs 25. The hang-in cut-outs 25 may have a substantially trapezoidal shape. The hang-in cut-outs 25 open towards the longitudinal edges of the braking lamella L.

The opened position of the flap cover K which is tilted open over substantially 150°, is stabilised in FIG. 3 by the action of the flaps 14 and the abutment surface 13 of the housing 1. The flap cover K may be opened and closed comfortably by gripping the handle 9.

Figure 6:
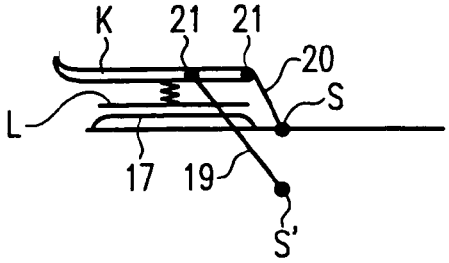
FIG. 6 is a section of a further embodiment.

In FIG. 6 the flap cover K is tiltably linked to the housing 1 by means of a link mechanism. The link mechanism includes, e.g. two substantially parallel links 19, 20 of different lengths. The links pivot about adjusting arbors S, S' which are offset to each other in vertical direction. The links engage in joints 21 at the flap cover K. The flap cover K may be lifted by means of the links 19, 20 while it is at the same time displaced to the right side in FIG. 4, until the braking zone 12 is cleared completely. For this embodiment similar flap cover positioning devices may be implemented as explained with the help of FIG. 3.

Figure 7:
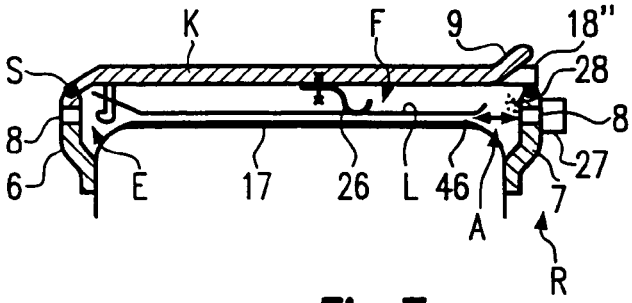
FIG. 7 is a schematic view of an embodiment in which the flap cover is linked in another fashion.

In the embodiment of FIG. 7 the adjusting arbor S e.g. is provided at the entrance side A of the yarn brake B. The adjusting arbor S is oriented substantially perpendicular to the yarn run path W and parallel to the fixed braking surface 17. A suitable location for the implementation of the adjusting arbor S e.g. may be the cheek 6 or 7 containing the yarn guiding element 8. The adjusting arbor S may be offset in upward direction in relation to the yarn path W, such that the opened flap cover K completely clears the braking zone 12. The closed position of the flap cover K may be defined by a stop 18" which abuts on the other cheek 7 or 6. Alternatively, the flap cover K could be linked to the housing 1 or to the solenoid housing 16, respectively. The exit side A of the yarn brake B opens due to the curved braking lamella L at location 46 in yarn run direction and in a diverging fashion. Into this location pressurised air 28 is blown for cleaning purposes counter to the yarn run direction and substantially parallel to the yarn run direction, e.g. by a nozzle 27. The pressurised air is blown in when the yarn Y has stopped and when the braking lamella L is not actuated magnetically, i.e., only rests on the fixed braking surface with low contact force. Then the braking lamella L is lifted somewhat from the fixed braking surface 17 by the blown in air such that the pressurised air efficiently releases and removes accumulated contamination.

Figure 8:
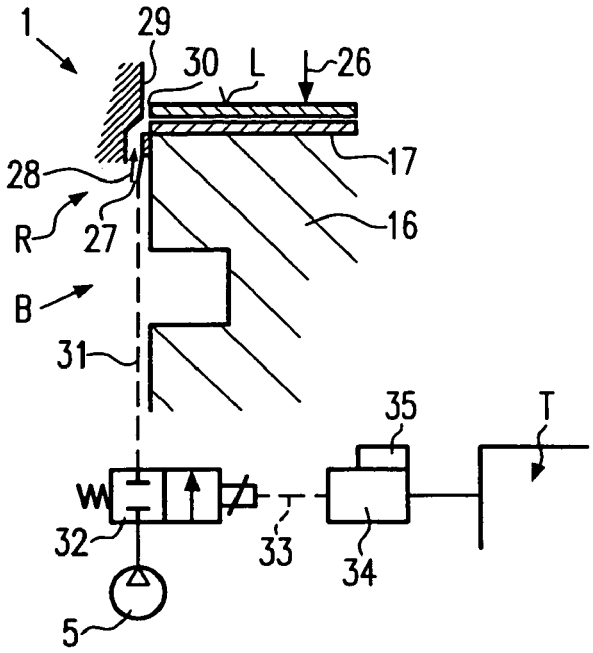
FIG. 8 is a vertical section of a detail variant.

The spring F shown in FIGS. 3 and 8 consists of a damping material like polyurethane, foam material, or a dead plastic material or rubber material, such that the spring actuates the braking lamella L by pressure but also suppresses oscillations. The spring F may be a polyurethane lip 26 having substantially S-shaped cross-section. The lip extends crosswise over the braking lamella, expediently over the full width of the braking lamella L. The spring is secured at the lower side of the flap cover K. Other damping materials also could be used to form the spring F. In case of a steel spring F, e.g. a spiral spring, the spiral spring could be equipped with a damping insert, e.g. made from one of the above-mentioned materials.

In a not shown alternative the adjusting arbor F could be provided with an orientation perpendicular to the yarn run path at the exit side A, different to FIG. 7.

In a further not shown alternative solution instead of the protruding handle 9 shown in FIGS. 1 and 2 a functionally equivalent handle could be provided at the flap cover K in the region of the adjusting arbor S. The flap cover K then could be snapped into the closing position but nevertheless being loaded by spring force in opening direction. The snap detent is to be opened by pressure on the flap cover before the spring force automatically pivots the flap cover, e.g. into the full opening position. The first snap detent of the flap cover in the closed position prevents that the snap cover K might be opened inadvertently during operation of the yarn brake B, e.g. due to vibrations caused by the operation.

The yarn brake B can be applied in any arbitrary position in the space. The position shown in FIGS. 1 and 2 is advantageous because of a self-cleaning effect caused by gravity.

In the detail variant in FIG. 8 (vertical section) a special pressurised air cleaning device R is integrated into the yarn brake B. The at least one nozzle 27 opens approximately below the longitudinal edge region of the braking zone constituted by the braking lamella L and the fixed braking surface 17, particularly at the side of the fixed braking surface 17 which faces towards the housing 1. In this case, e.g., the blow direction is essentially vertical. A throttling gap 30 is provided downstream of the nozzle 27. The throttling gap is bound by the longitudinal edge of the braking lamella L facing towards the housing 1 and a surface 21 of a wall extending substantially vertically. The dimension of the throttling gap 30 is made so small that the braking lamella L may not or not significantly contact the surface 29 in case of lifting movements caused by the actuation by pressurised air. An air jet (or air jet pulses) exiting from the nozzle 27 is indicated by reference numeral 28.

The nozzle 27 is connected via a supply pipe 31 to a solenoid valve 32 and to the pressurised air supply 5. The solenoid valve 32 is controlled via a control line 33 by an actuation control device 34 which, in some cases, is provided with a programmable section 35. The actuation control device 34 may be connected with the control device (not shown) of the yarn brake B and/or the control device of the textile machine T, in this case a weaving machine, in order to activate the nozzle 27 depending on the magnetic deactivation of the yarn brake B and/or on the operating cycles of the weaving machine. A cleaning cycle, e.g., is carried out after the weaving shed has been closed and after the solenoid of the yarn brake has been de-energised at least partially, and after the yarn has stopped. This may happen after each pick, or in programmed fashion (by means of the programmable section 35) after a predetermined number of picks and/or at random.

The pressurised air cleaning devices R of several of such yarn brakes B may be commonly connected to the solenoid valve 32. However, a single solenoid valve per yarn brake may be expedient for the reason that several yarn brakes of the same weaving machine will be activated or deactivated at different points in time.

Figure 9:
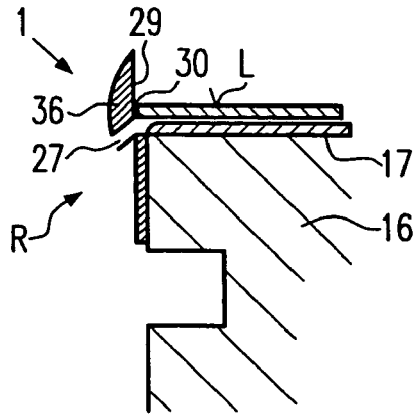
FIG. 9 is a vertical section of a further detail variant.

In the detail variant shown in a vertical section in FIG. 9 the surface 29 is provided on a deflector body 36 which is positioned at the housing 1 of the yarn brake and/or at a suitable location such that it commonly defines the throttling gap 30 together with the inner edge of the braking lamella L. The braking lamella L, in this embodiment, is broader than the fixed braking surface 13 at the side facing the housing 1. The blowing direction of the nozzle 27 is oriented obliquely into the braking zone between the braking lamella L and the fixed braking surface 17. The inner edge of the fixed braking surface 17 may be chamfered or rounded in order to form a wedge-shaped inlet portion for the air.

Figure 10:
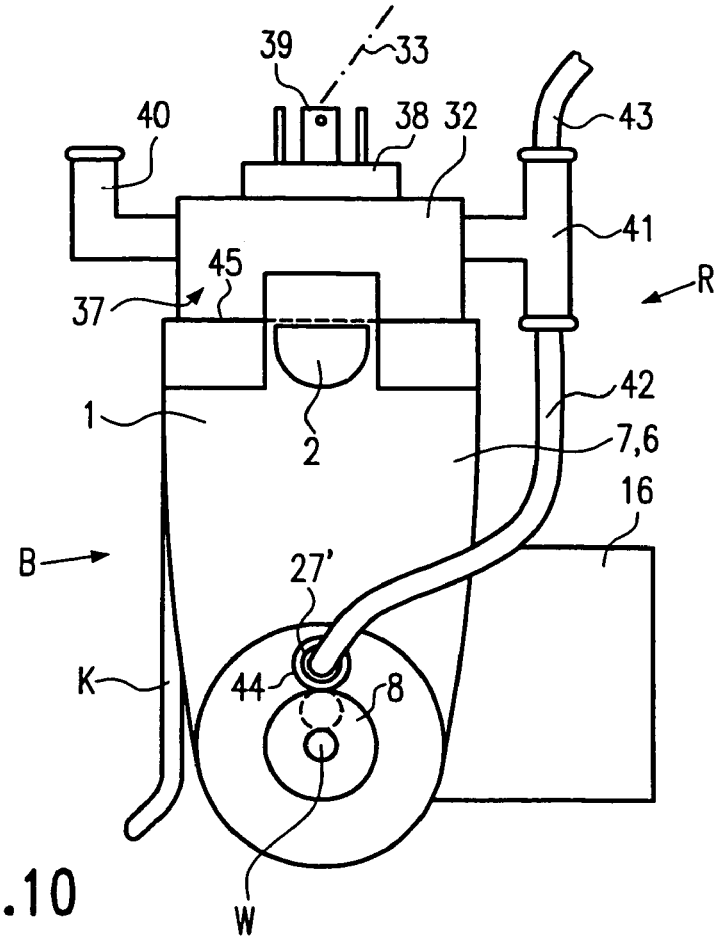
FIG. 10 is a rear view of a further embodiment.

In the embodiment of the yarn brake B shown in FIG. 10 in a view from the rear, a nozzle 27' is mounted e.g. in the exit side cheek 6 (or alternatively or additively, in the entrance side cheek 7). The nozzle 27 is offset in the plane of the braking zone sidewards relative to the yarn run path W. The blowing direction of the nozzle 27 points into the braking zone. The nozzle 27' is secured in a mounting device, e.g. a holding bore 44 which is provided either in the cheek 7 or in the cheek 6, respectively. Alternatively, (indicated in dotted lines) the nozzle 27 could be structurally integrated into the yarn guiding element 8 or could be inserted into a hole provided in the yarn guiding element 8. At mounting devices 45 provided at the upper side of the housing 1 a block 37 is located which is a structural unit consisting of the solenoid valve 32 having an actuating solenoid 38 and connector tabs 39. The solenoid valve 32 may have a venting facility 40. Furthermore, a T-connector 41 is provided to which a pressurised air hose 43 from the pressure supply 5 and a pressurised air conduit (a hose) 42 are connected. The conduit 42 leads to the nozzle 27'. The flap cover K is shown in the closed position. Instead of only a single nozzle 27' several nozzles could be provided in the plane of the braking zone. In a similar fashion such a nozzle 27' could be provided also or only at the not shown entrance side in a position analogous to the shown position of the nozzle 27'.

The nozzle 27' is actuated, expediently, by pressurised air as soon as the yarn brake B is magnetically de-energised and as soon as the yarn has stopped to run along the yarn run path W. The blowing direction of the nozzle 27' is FIG. 10 is counter and substantially parallel to the yarn run direction and is directed in the diverging exit side A. The nozzle 27' blows sidewardly offset in relation to the yarn run path W which per se is kept clean by the yarn itself. During a cleaning cycle using one or several pressurised air jets contamination present in the region of the braking zone is blown away. During the cleaning the braking lamella L which only is loosely held by the pin anchors 11, is allowed to move or lift in relation to the fixed braking surface 17, assisted by the pressurised air spreading effect in the diverging exit side. Control of the pneumatic cleaning device R is carried out, expediently, in adaptation to the deactivation of the yarn brake and when the yarn has stopped and/or in adaptation to the operation cycle of the associated weaving machine. The blowing direction counter to the yarn run direction is of advantage, since a blowing direction in yarn run direction could cause a further movement of the yarn out of the not shown yarn feeding device or could, respectively, undesirably relax the section of the yarn extending from the yarn brake towards the insertion device of the weaving machine. The blowing direction counter to the yarn run direction keeps the yarn section between the yarn brake and the insertion device stretched even in case of lifting motions of the braking lamella L caused by the cleaning cycle. The nozzle 27' may be supplied with pressurised air in permanent or pulsating fashion. The solenoid valve 32 expediently is a 2/2-ways valve held in a blocking position by a valve spring and switches into the open position after the solenoid 38 has been energised. In some cases, the solenoid valve may be combined with an adjustment device for adjusting the pressure or the flow rate of the pressurised air. Furthermore, a manual actuation of the solenoid valve could be provided in order to allow to repeatedly actuate the solenoid valve manually, e.g., in order to remove tenacious contamination, then, in some cases, after first slightly lifting the flap cover K by hand.

According to a further important aspect of the invention the yarn brake B can be prefabricated already with the mounting devices 44, 45 in order to allow to mount the pressurised air cleaning device upon demand at the yarn brake B. (The pressurised air cleaning device expediently is a kit consisting of the solenoid valve 32, the pressurised air connections 42, 43, and the nozzle 27', a so-called retrofit kit.) This is expedient, e.g., for a case when for the first time yarn qualities will be processed in the weaving machine which could produce critical contamination jeopardising the proper function of the yarn brake.

In a not shown alternative solution the solenoid 32 even could be installed separated from the yarn brake B. As a further alternative a connecting line could be installed to the nozzle 27', which leads to the nozzle 27' from a solenoid valve of a valve block or from a solenoid valve which is arranged in common for several yarn brakes.

The pressurised air cleaning device R as shown and described with reference to FIGS. 7, 8, 9 and 10, even may be selectively combined with and/or integrated into the yarn brake B.

The diverging opening exit side A, 46 (FIG. 7), as naturally present in lamella yarn brakes is particularly suitable for cleaning with pressurised air by blowing counter to the yarn run direction in order to efficiently remove contamination. The divergently opening exit side results from the fact that the braking surfaces depart from each other behind the braking zone, because there is at least one curvature or inclination, or because the braking lamella has a bent configuration. For this reason the pressurised air cleaning device R applying a blowing direction into the exit side is not only expedient for controlled lamella yarn brakes but also for uncontrolled lamella yarn brakes (constant leaf tensioners) comprising a braking lamella and a fixed braking surface or comprising two braking lamellas which are resiliently pressed against each other. In any case, a cleaning cycle expediently is carried out only when the yarn has stopped.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. Yarn brake for a weaving machine, comprising:

a braking lamella which is actuable at least electromagnetically against a fixed braking surface;

a housing supporting the fixed braking surface and containing at least one solenoid;

a cover carrying the braking lamella, which cover can be lifted from a closed position relative to the fixed braking surface; and at least one adjusting arbor for controlling lifting movements of the cover, which adjusting arbor is provided at the housing in geometric association to a yarn run path through the yarn brake, wherein the cover is a flap cover which is cantilevered freely at one side, the flap cover being tiltable into an opened position about the adjusting arbor for completely clearing a braking zone of the yarn brake and consisting of non-magnetic material like light metal or plastic.

2. The yarn brake as in claim 1, wherein the adjusting arbor is provided substantially parallel to the yarn run path and is offset sidewardly of the fixed braking surface and the yarn run path.

3. The yarn brake as in claim 1, wherein the adjusting arbor is at least substantially parallel to the fixed braking surface and is provided at least essentially perpendicular to the yarn run path, with an offset to the yarn run path.

4. The yarn brake as in claim 3, wherein the adjusting arbor is provided in a yarn run direction along the yarn run path either in front of an entrance side or behind an exit side of the fixed braking surface.

5. The yarn brake as in claim 1, wherein the adjusting arbor is a flap cover tilting hinge.

6. The yarn brake as in claim 1, wherein the flap cover is linked by a link mechanism to several adjusting arbors, the link mechanism comprising two links of differing lengths.

7. The yarn brake as in claim 1, wherein the flap cover is provided with a gripping handle having an upwardly bent portion at an end region of the flap cover remote from the adjusting arbor.

8. The yarn brake as in claim 1, wherein in front of an entrance side and behind an exit side, yarn guiding elements defining the yarn run path are provided, the yarn guiding elements being fixed to the housing, and the flap cover in the closed position is situated in-between the yarn guiding elements.

9. The yarn brake as in claim 1, wherein the tilting angle of the flap cover is larger than 90°.

10. The yarn brake as in claim 1, wherein at least one positioning device is provided for the closed position and/or the opened position or for several different opened positions of the flap cover, and the positioning device co-operates with the flap cover by a form-fit and/or a force fit.

11. The yarn brake as in claim 10, wherein the positioning device comprises elastic snap detent mechanisms and abutment surfaces for the flap cover, and the elastic snap detent mechanisms are fixed to the housing.

12. The yarn brake as in claim 1, wherein the flap cover carries at a lower side a pair of substantially vertical protruding pin anchors which are juxtaposed to each other essentially crosswise to the yarn run path and loosely hold the braking lamella, the pin anchors being provided at an entrance side of the fixed braking surface.

13. The yarn brake as in claim 12, wherein the braking lamella is formed with hang-in cut-outs for the pin anchors, the hang-in cut-outs being open towards both longitudinal edges of the braking lamella.

14. The yarn brake as in claim 1, wherein at least one brake lamella actuating spring is provided at a lower side of the flap cover.

15. The yarn brake as in claim 14, wherein the spring consists of damping material comprising one of: polyurethane; foam material; elastomer; and rubber material.

16. The yarn brake as in claim 15, wherein the spring is an S-shaped polyurethane lip extending along the lower side of the flap cover in a lateral direction and essentially over the full width of the braking lamella.

17. Yarn brake for a weaving machine, comprising:

a braking lamella which is actuable at least electromagnetically against a fixed braking surface;

a housing supporting the fixed braking surface and containing at least one solenoid;

a cover carrying the braking lamella, which cover can be lifted from a closed position relative to the fixed braking surface;

at least one adjusting arbor for controlling lifting movements of the cover, the adjusting arbor being provided at the housing in geometric association to a yarn run path through the yarn brake, the cover being a flap cover which is cantilevered freely at one side, the flap cover being tiltable into an open position about the adjusting arbor for completely clearing a braking zone of the yarn brake; and at least one cleaning nozzle for selectively actuating the braking zone by pressurized air, the cleaning nozzle being connected to a pressure supply, an exit portion of the cleaning nozzle being provided close to a longitudinal edge region of the braking zone between the fixed braking surface and the braking lamella, the exit portion being shielded downstream of the nozzle by a throttling gap, and the throttling gap being bound by a surface of a wall which extends substantially perpendicular to the fixed braking surface, and by the braking lamella.

18. The yarn brake as in claim 17, wherein the braking lamella is broadened in relation to the fixed braking surface in order to form a boundary of the throttling gap.

19. The yarn brake as in claim 17, wherein in at least one cheek containing a respective yarn guiding element, the nozzle is mounted, a blowing direction of the nozzle being substantially parallel to the yarn run path and being sidewardly offset in relation to the yarn run path in a plane of the braking zone, the blowing direction being oriented substantially into the braking zone.

20. The yarn brake as in claim 17, wherein the nozzle is mounted in the yarn guiding element.

21. The yarn brake as in claim 17, wherein the nozzle is mounted in the cheek provided at an exit side, and the blowing direction of the nozzle is counter to a yarn running direction along the yarn run path.

22. The yarn brake as in claim 17, wherein the nozzle is connected to a solenoid valve which in turn is connected to the pressure supply, the solenoid valve being connected to an actuation control device of the yarn brake and/or a control device of the weaving machine.

23. The yarn brake as in claim 22, wherein the actuation control device comprises a programmable section for programming cleaning cycles depending on deactivated cycles of the yarn brake and/or operating cycles of the weaving machine.

24. The yarn brake as in claim 22 wherein the nozzle, the solenoid valve and at least one pressurized air connection between the nozzle and the solenoid valve commonly constitute a kit which is mounted at the yarn brake.

25. The yarn brake as in claim 22, wherein the yarn brake is provided with mounting devices for the kit by a retrofit mounting procedure.

26. Method for cleaning a yarn brake by means of a pressurized air cleaning device, the yarn brake comprising a braking surface and a braking lamella which is resiliently pressed against the braking surface, the braking surface and the braking lamella commonly forming a braking zone for an intermittently running yarn, the braking lamella being selectively and forcefully pressed by magnet force actuation against the braking surface, the method comprising the steps of:

blowing pressurized air only into the braking zone when the braking lamella is magnetically deactivated; and blowing the pressurized air into an exit side of the yarn brake essentially counter to a yarn run direction, the exit side of the yarn brake divergently opening in the yarn run direction.

27. The yarn brake as in claim 17, wherein several nozzles are provided along an edge of the fixed braking surface.

28. The yarn brake as in claim 9, wherein the tilting angle of the flap cover is 180°.

29. The yarn brake as in claim 14, wherein the spring contains a damping insert made of damping material.

30. The method as in claim 26, wherein the step of blowing the pressurized air into the exit side of the yarn brake is performed when the yarn has stopped.

* * * * *